United States Patent [19]

Brasted et al.

[11] Patent Number: 4,607,982

[45] Date of Patent: Aug. 26, 1986

[54] METHOD AND APPARATUS FOR INSTALLATION OF AN OFFSHORE PLATFORM

[75] Inventors: Lee K. Brasted, Kingwood; George L. Uppencamp, Spring, both of Tex.

[73] Assignee: Shell Oil Company, Houston, Tex.

[21] Appl. No.: 696,819

[22] Filed: Jan. 31, 1985

[51] Int. Cl.[4] ..... E02B 17/08; E02D 21/00; E02D 25/00

[52] U.S. Cl. ..... 405/204; 405/195; 405/203; 405/221

[58] Field of Search ..... 405/195, 202–207, 405/209, 211, 227, 196, 221, 229; 52/167

[56] References Cited

U.S. PATENT DOCUMENTS

| | | | |
|---|---|---|---|
| 3,859,806 | 1/1975 | Guy et al. | 405/204 |
| 4,055,264 | 10/1977 | Abbott | 405/209 X |
| 4,121,393 | 10/1978 | Renault et al. | 52/167 |
| 4,222,683 | 9/1980 | Schaloske et al. | 405/204 |
| 4,252,468 | 2/1981 | Blight | 405/204 |
| 4,405,262 | 9/1983 | Nagashima | 405/229 X |
| 4,436,454 | 3/1984 | Ninet et al. | 405/204 |
| 4,453,859 | 6/1984 | Sedillot et al. | 405/202 |

FOREIGN PATENT DOCUMENTS

| | | | |
|---|---|---|---|
| 2609823 | 12/1976 | Fed. Rep. of Germany | 405/204 |
| 8103191 | 11/1981 | PCT Int'l Appl. | 405/204 |

*Primary Examiner*—Cornelius J. Husar
*Assistant Examiner*—Nancy J. Stodola

[57] ABSTRACT

A method and apparatus are disclosed for use in the installation of a platform structure upon the upper elements of a previously-installed substructure. The platform structure is mounted on a barge positionable between the upper elements of the previously-installed substructure. The barge can be flooded and lowered a sufficient distance to allow leg elements of the platform structure to contact and mate with leg support elements of the substructure.

Impacts between the structures during the mating operation are absorbed by resilient neoprene pads carried by the leg supports. After the platform structure rests upon the leg supports, and the barge is removed, the platform structure can be lowered and leveled by draining a select volume of sand from the leg supports.

3 Claims, 5 Drawing Figures

FIG.1
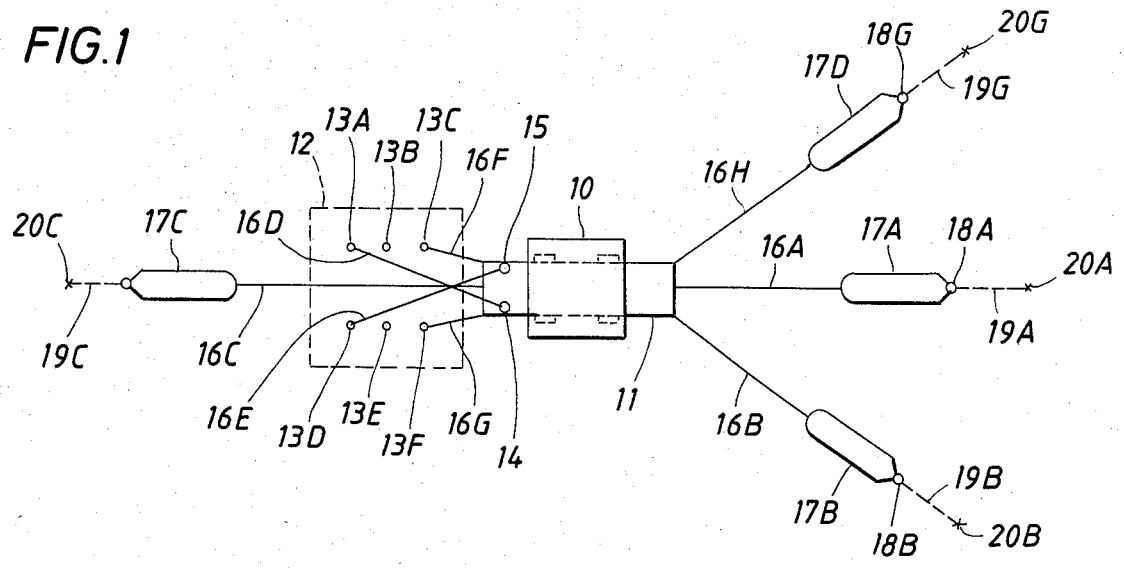
FIG. 2
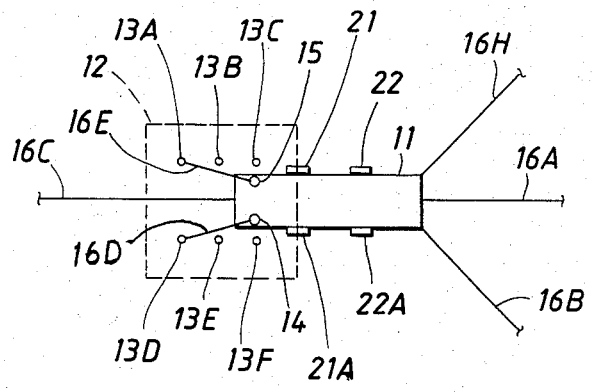
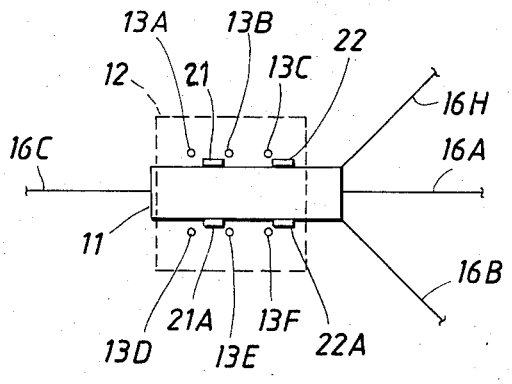
FIG. 3
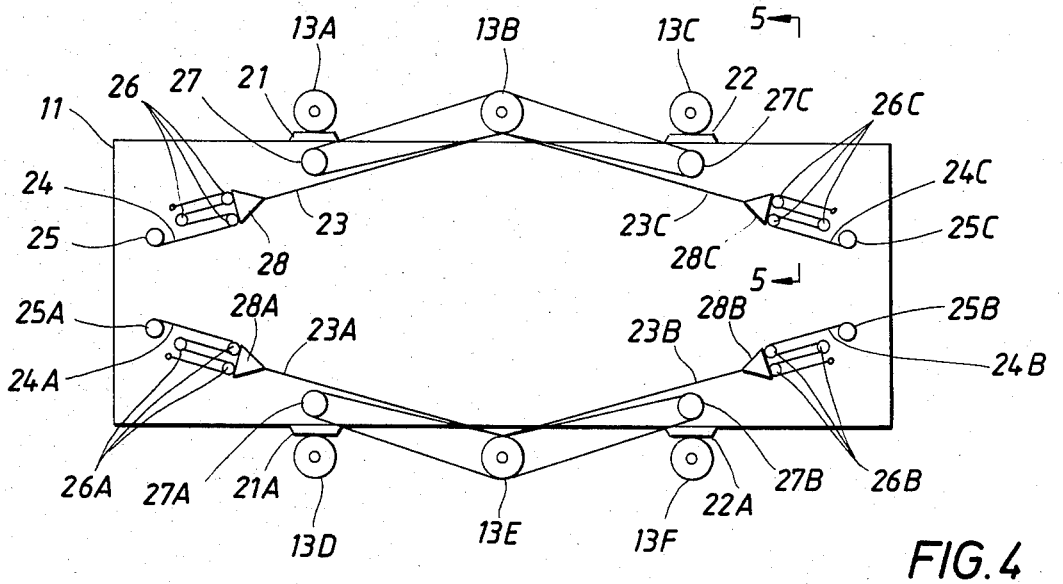
FIG. 4

METHOD AND APPARATUS FOR INSTALLATION OF AN OFFSHORE PLATFORM

BACKGROUND OF THE INVENTION

1. Field of the Invention:

The present invention relates to an apparatus and method for use in the installation of an offshore platform structure above a previously-installed substructure.

2. Description of the Prior Art:

As the exploration for oil and gas reserves has progressed into offshore waters, platforms capable of supporting the required drilling and production equipment have been installed above promising petroleum reservoir locations.

Each platform is usually installed in two or more separate sections. The first section consists of a partially submerged substructure supported by the ocean floor. A portion of this substructure extends above the surface of the water. A platform structure which forms the upper second section is then placed upon the substructure. The platform structure usually has an array of four to eight downwardly-depending legs which mate with and are welded to a corresponding array of four to eight upwardly-directed leg supports which form the upper portion of the substructure.

The platform structure is placed upon the substructure by a derrick barge. This barge carries a crane of sufficient weight-lifting capacity to lift the platform structure from an equipment supply vessel, position the platform structure over the substructure, and then lower the structure downward until the legs of the structure contact the leg supports of the substructure.

As can be imagined, even minor five to six foot ocean swells that periodically impact the derrick barge can cause the platform structure, when suspended by cables from the crane, to swing back and forth similar to a pendulum. Upward and downward movement of the derrick barge will also cause similar movements in the suspended platform. The final mating alignment between the legs and leg supports is usually very difficult, with damaged mating members not uncommon as the platform structure pounds up and down on the support legs, until the weight of the platform structure is fully transferred to the substructure.

As can be imagined, failure of the crane as the platform structure is suspended in the air could cause catastrophic loss of the platform structure with attendant risk to human life on the platform substructure, equipment supply vessel, and derrick barge.

There are economic disadvantages as well in the use of such a derrick barge, due to the cost of its operation. In some undeveloped areas of the world, the use of such a derrick barge would be economically unfeasible due to the high cost associated with the single trip of the barge to a country having minimum petroleum reservoir development.

Accordingly, it is desirable to present a method and apparatus for installation of a platform structure without the damage, danger and expense associated with use of a derrick barge.

Additionally, after the platform structure has been placed upon the substructure an inordinate amount of time usually must be spent in welding the legs of the platform structure to the substructure's leg supports, due to misalignments which exist between the legs and leg supports. Accordingly, it is also desirable to present a method and apparatus that allows final mating adjustments to be made between the legs and leg supports prior to welding the legs and leg supports together.

SUMMARY OF THE INVENTION

The apparatus of the present invention used to assist in the final connection of the platform structure to the substructure comprises a plurality of leg-receiving receptacles formed at the upper end of the substructure's leg supports. Each receptacle contains a volume of particulate material, such as sand, and also a resilient neoprene pad carried above the sand that dampens the impacts that occur as the platform structure's legs are lowered and subsequently mated with the leg-receiving receptacles of the substructure. Once the load of the platform structure is transferred to the substructure's leg supports, the sand may be drained from the receptacles in order to precisely level the platform structure and also to accurately position each leg adjacent each leg support a distance sufficient for welding each leg to each leg support.

The platform structure is initially secured to a variable-draft equipment vessel. The equipment vessel with attached platform structure is thereafter accurately positioned between the leg supports of the substructure which have been previously designed and fabricated to allow such a vessel to pass between them. The vessel is then lowered by flooding with water or by tidal action or combination of the two. As the vessel lowers, the legs of the platform structure mate with the substructure's leg supports.

In this manner, the equipment vessel that transports the platform structure to the substructure can be used to mate both structures together, without the use of a derrick barge. Since the vessel can be designed or modified to fit snugly between the leg supports during the mating operation, very little sideward movement will be encountered between the legs and leg supports, with a corresponding reduction in the amount of damage sustained by both structures.

It is an object of the present invention to provide apparatus for use in the installation of a platform structure upon a substructure. It is a further object of the present invention to describe a method of installation of a platform structure upon a substructure.

These and other features, objects, and advantages of the present invention will become apparent from the following detailed description, wherein reference is made to the figures in the accompanying drawing.

BRIEF DESCRIPTION OF THE DRAWINGS

FIG. 1 is a schematic representation showing an equipment vessel carrying a platform structure positioned prior to entrance between the leg supports of a substructure.

FIG. 2 is a schematic representation of the equipment vessel entering the area between the leg supports of the substructure.

FIG. 3 is a schematic representation showing the equipment vessel prior to final positioning between the leg supports.

FIG. 4 is a schematic representation of the equipment vessel in final position between the leg supports.

DESCRIPTION OF THE PREFERRED EMBODIMENT

Figure 5:
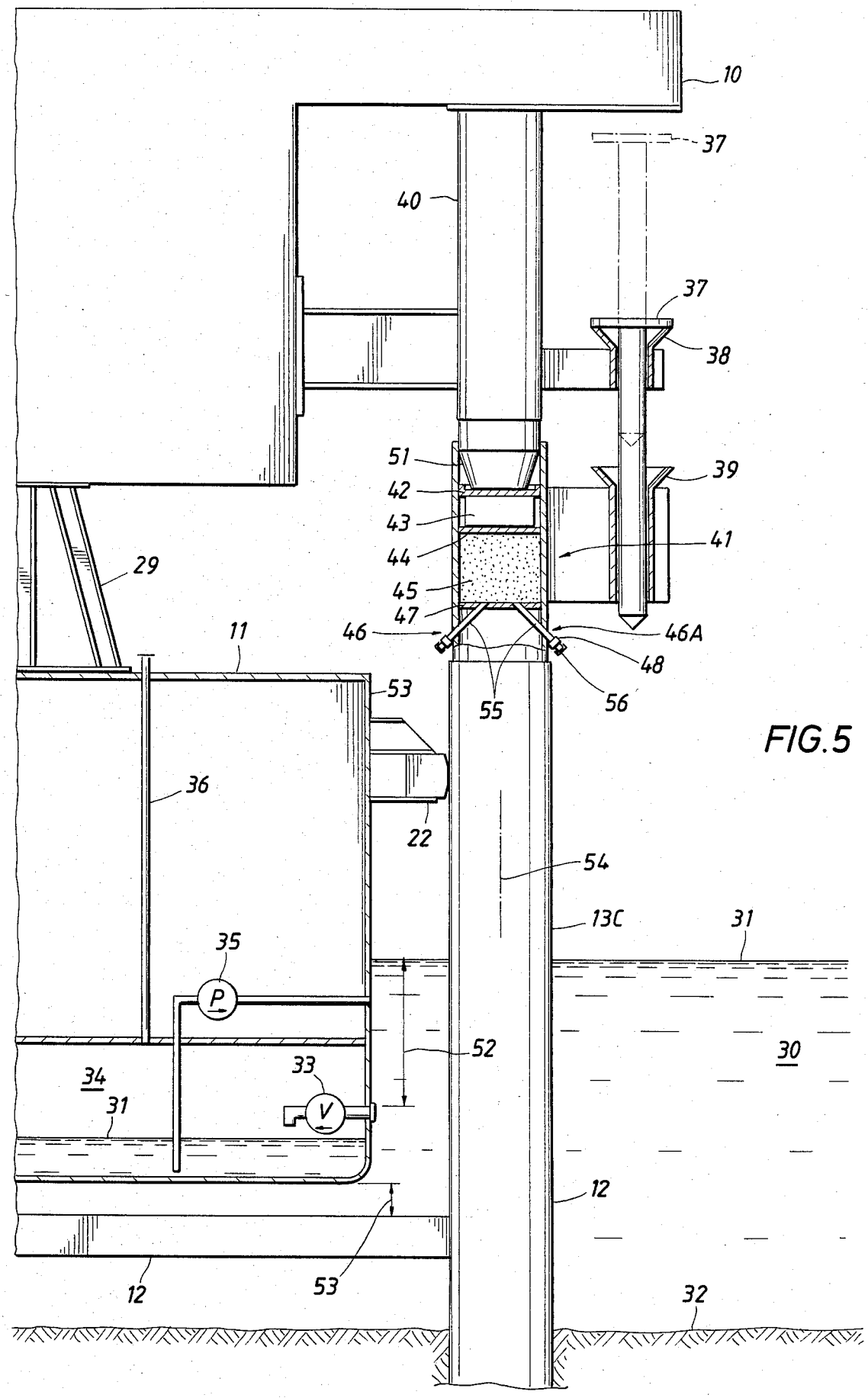
FIG. 5 is a partial view in cross section taken along lines 5—5 of FIG. 4 after the platform structure has been lowered onto the leg supports of the substructure.

Referring now to FIG. 1, an offshore platform structure 10 is shown mounted on the deck of a variable-draft equipment vessel 11. The structure 10 may have been securely welded to the vessel 11 during transportation of the structure 10 to the general vicinity of the substructure 12. The height or draft of the vessel 11 may be varied by partially flooding portions of the vessel 11 as explained later. The vessel 11 is shown positioned adjacent the substructure 12 that has previously been attached to the ocean floor 32 (FIG. 5). Upwardly-directed legs 13A–F extend above the surface 31 of the body of water 30 (FIG. 5). Winches 14, 15, are shown carried by the deck of the equipment vessel 11. Cables 16A–H, assist in positioning the vessel 11 between auxiliary vessels 17A–D, and substructure 12. Auxiliary vessel 17D is shown moored to buoy 18G. Buoy 18G is connected by means of another cable 19G to a subsea anchor 20G well known to the art. The other auxiliary vessels 17A–C are also moored by means of buoys 18A–C, cables 19A–C, and anchors 20A–C.

Referring now to FIG. 2, for the purpose of clarity of offshore structure platform 10 is not shown carried upon the deck of vessel 11. Vessel side extensions 21, 21A, 22, 22A are shown attached to or respectively form a portion of the sides of vessel 11. These side extensions 21, 21A, 22, 22A may be formed from wooden members attached to the side of the vessel 11, or by members welded to the side of the vessel 11.

Referring now to FIG. 4, the vessel 11 is shown positioned within the leg supports 13A–F of the substructure 12. Vessel side extensions 21, 21A, 22, 22A are shown contacting leg supports 13A, 13D, 13C and 13F respectively.

A cable 23 such as a five part nylon rope 10 inches in diameter is shown used in combination with a cable 24 such as $1\frac{1}{4}$ four-part steel cable. Both cables 23, 24 can be tensioned by winch 25 and in combination with cable sheaves 26, bollard 27, and fishplate 28 form a system of securing a portion of the vessel 11 to leg support 13B. In a similar manner cables 23A, B, C cables 24A, B, C, winches 25A, B, C, cable sheaves 26A, B, D, bollards 27A, B, C and fishplates 28 A, B, C can be used to secure other portions of the vessel 11 to leg supports 13B or 13E.

Referring now to FIG. 5, the offshore platform structure 10 is shown positioned above vessel 11 and carried by support 29. The vessel 11 is shown floating in the body of water 30 having surface 31 and bottom 32. A flood valve 33 carried by the vessel 11 when opened may place a portion of the body of water 30 in fluid communication with the vessel's 11 ballast tank 34. A pump 35 well known to the art may add or remove the water 30 from the ballast tank 34 when desired. It is recognized that many ballast tanks 34 and pumps 35 may be incorporated within a single vessel 11. A vent line 36 defined upwardly through the vessel 11 allows air to be vented from the ballast tank 34.

A docking pole 37 such as a cylindrical steel member having a tapered lower end and an upper retainer shoulder is shown passing downwardly through guides 38 and 39.

For purposes of clarity a single platform structure leg 40 is shown with its lower end positioned within leg-receiving receptacle 41. It is recognized that a plurality of legs 40 fit within receptacles 41 located at the upper end of leg supports 13A–F. The lower end of structure leg 40 contacts upper bearing plate 42, which rests upon resilient material means 43 such as a neoprene pad. The resilient material means 43 rests upon lower bearing plate 44 which is carried by the upper surface of a volume of particulate material 45 such as sand well known to the art. Drain means 46, 46A such as conduits placed in fluid communication with the particulate material 45 may be used to drain a portion of the particulate material 45 from the receptacle 41. The drain means 46, 46A pass upwardly through closure means 47 such as a steel plate well known to the art which supports the lower portion of the particulate material 45. Valve means 48 can be used to control the draining of the particulate material 45 from the receptacle 41. A leg cone 51 forming the lower end of the platform structure leg 40 has a downwardly-directed tapered configuration in order to aid in the alignment and subsequent mating of structure leg 40 to receptacle 41. Substructure leg support 13C is shown forming a portion of the substructure 12 which enters the bottom of the body of water 32.

A draft-variance dimension 52 is shown to indicate the depth to which the vessel 11 may be submerged without decreasing the clearance dimension 53 sufficiently to cause the vessel 11 to contact the substructure 12.

The apparatus shown in FIGS. 1–5 is used to position, lower, and connect the lower end of the downwardly-depending legs 40 of the offshore platform structure 10 to the upper ends of upwardly-directed leg supports 13A–F of the substructure 12. One of several leg-receiving receptacles 41 is shown having an open top and a chamber defined downwardly through the upper end of at least a plurality of the substructure leg supports 13A–F. Although receptacles 41 may be defined at the top of each substructure leg 13A–13F, it is well recognized that receptacles 41 need not be defined at the top of every leg support 13A–F.

The closure means 47 formed at the lower end of the receptacle 41 may also be formed from a cementaceous substance such as concrete poured into each of said respective leg supports 13A–F. Closure means 47 need be positioned at a selected distance from the top of the receptacle 41 in order to allow a selected mass of the particulate material 45 to be positioned in the lower portion of each receptacle 41. The location of the closure means 47 should also be positioned a sufficient distance down from the top of the receptacle 41 so the drain means 46, 46A, which are connected in fluid communication with the lower portion of the receptacle 41, may be allowed to drain enough particulate material 45 from the receptacle 41 in order to provide sufficient space above the material 45 to accommodate leg cone 51 of the leg 40 as it enters the receptacle 41. The closure means 47 may comprise steel plate means positioned perpendicular to a longitudinal axis 54 which is defined along the length of leg supports 13A–13F.

In a preferred embodiment the drain means 46, 46A may comprise three particulate material 45 conduits 55 of a size and location to allow approximately one-third of the particulate material 45 to be drained from the receptacle 41 through each of said conduits 55. It is necessary to drain the particulate material 45 evenly from the receptacle 41 in order to allow the lower bearing plate 44 to settle evenly downward through the receptacle 41 so the structure leg 40 will settle within the receptacle 41 without binding. It is recognized that one or more conduits 55 may be used to drain material 45 from the receptacle chamber 41, depending upon the overall size of the receptacle 41.

The particulate material 45 conduits 55 may pass upwardly from a position outside the leg supports 13 A–F and thereafter upwardly through the closure means 47. In this manner personnel located outside of leg supports 13A–F may easily monitor the rate of removal of the particulate material 45 from the receptacle 41. Conduits 55 may have a removable cap 56 placed in threaded engagement with the conduit 55 in order to prevent flow of particulate material 45 from the receptacle 41 when cap 56 is placed in threaded engagement with the conduit 55.

The resilient material means 43 mentioned earlier may comprise alternating horizontal layers of steel plate and neoprene with the upper and lower ends of the resilient means 43 formed with layers of steel plate. The resilient material means 43 may be sized and ordered from Oil States Industries, Inc., Bearing Pad Division, P. O. Box BPD, Athens, Tex. 75751. Depending upon the impact loads expected from the platform structure 10 during the mating operation with the leg supports 13A–F the number of layers of neoprene incorporated within each resilient material means 43 may be designed to yield different overall deflection of the resilient means 43. In this manner the contact forces between the structures 10, 12 may be cushioned within an acceptable range of values, depending upon the anticipated sea state, the load of the structure, and the relative movement between the vessel 11 and the leg supports 13A–F.

Referring to FIG. 1, in operation the vessel 11 is initially secured by cables 16F and 16G and cables 16E and 16D connected to winches 14, 15 to the respective legs 13C, 13F, 13D, and 13A of the substructure 12, and also secured by cables 16H, 16A, B, C to auxiliary vessels 17A, B, C, D. The length of the cables 16A–H is adjusted in a manner to draw the vessel 11 within the substructure legs 13A–F.

As shown in FIG. 2, in a preferred embodiment cables 16E and 16D may now be connected to leg supports 13A and 13D respectively in order to continue movement of the vessel 11 within the leg supports 13A–F. The vessel side extensions 21, 21A have not yet passed by leg supports 13C and 13F.

As shown in FIG. 3 the vessel 11 is now near its final position within the leg supports 13A–13F of the substructure 12. Vessel side extensions 21, 21A and 22, 22A have not yet contacted their respective leg supports 13A, D, C, F respectively. It is preferred that there be a minimum of five feet mean clearance between the leg cone 51 (shown in FIG. 5) and the upper end of the receptacle 41 (shown in FIG. 5) prior to entry of the vessel 11 into the slot defined between the leg supports 13A–F.

Referring now to FIG. 4, the vessel 11 is shown finally positioned between leg supports 13A–F. Side extensions 21, 21A and 22, 22A are now adjacent leg supports 13A, D, C and F respectively. In a preferred embodiment the vessel's side extensions 21, 21A, 22, 22A do not fully contact the leg supports 13A, D, C and F until the vessel 11 is lowered by flooding a portion of the draft variance distance 52 (FIG. 5). As the vessel 11 reaches this final position the cables 23, 23A and cables 24, 24A are first rigged around legs 13B and 13E and back to bollards 27, 27A by means well known to the art. Once the vessel 11 is centered in the desired position the cable 23B, 23C and cables 24B and 24C are rigged from winches 25B, 25C around leg supports 13B and 13E and back to bollards 27B and 27C, by means well known to the art in order to stabilize the vessel 11 within the slot defined between the leg supports 13A–F.

Referring now to FIG. 5 at this point in time the docking pole 37 is allowed to drop down through guides 38 and 39 of leg support 13C. In a preferred embodiment another docking pole (not shown) is also dropped at leg support 13D (FIG. 4). Similar docking poles are then also dropped downwardly at legs 13A and 13F in order to continue the stabilization of the vessel 11 within the leg supports 13A–F. The legs 40 of the platform structure 10 have now been positioned substantially centrally above the substructure leg supports 13A–F. It should be noted that cables 23, 23A and cables 23B and 23C (FIG. 4) may be alternatively tensioned by their respective winches 25, 25A, B, C in order to apply a sufficient lateral restraining force to the vessel 11 in order to reduce to acceptable limits any movement of the vessel 11 due to waves which impact the vessel 11.

The platform structure legs 40 are then lowered towards the substructure leg supports 13A–F, by flooding vessel 11 with a portion of the body of water 30 which flows through flood valve 33 into ballast tank 34. As can be seen as the vessel 11 lowers in the body of water 30, the leg cone 51 of the structure leg 40 approaches and eventually passes downward through the upper portion of receptacle 41. Before the vessel 11 is lowered, the sides of the vessel 11 should be outwardly extended adjacent the substructure leg supports 13A, D, C, and F a distance sufficient to cause the vessel 11 sides to operatively contact at least one pair of leg supports 13A, D or 13C, F located on each side of the vessel 11, preferably before the leg cone 51 enters the receptacle 41, in order to more fully restrain the vessel 11 within the leg supports 13A–F. In a preferred embodiment, the vessel side extensions 21, 21A, 22, 22A may be formed from sections of hard wood such as mahogany. Use of mahogany will allow the side extensions 21, 21A, 22, 22A to abraid at a slow rate when they contact the leg supports 13A, D, C and F, and should not cause noticeable wear to the leg supports 13A, D, C, and F.

As the vessel 11 is lowered a portion of the draft variance 52 dimension into the body of water 30, the leg cone 51 of at least one of the platform structure legs 40 will operatively contact the particulate material 45 positioned in the lower portion of each receptacle chamber 41. This operative contact may be done in a resilient manner by positioning resilient material means 43, such as the neoprene pad assembly mentioned earlier, between the leg cone 51 and the particulate material 45, prior to contact of the leg 40 with the particulate material 45. In a preferred embodiment the resilient material means 43 are carried by the upper surface of the particulate material 45, although it is recognized that resilient material means 43 may also be incorporated into the leg cone 51, or in any other mechanically equivalent location to allow the same resilient contact between the structure legs 40 and their respective leg supports 13A–F.

In a preferred embodiment the vessel 11 will continue to be flooded until the full load the structure 10 has been transferred to the leg supports 13A–F. The vessel 11 will then be flooded an additional amount to allow the supports 29 to be removed from beneath the structure 10. The resilient material means 43 will be compressed in each receptacle 41 after the supports 29 are removed from beneath the structure 10. Once the supports 29 are removed, the vessel 11 may be removed from beneath the structure 10. It is understood that a plurality of supports 29 may be used to support the structure 10 on the vessel 11.

The entire platform structure 10 may now be leveled to a desired horizontal elevation by selective draining of particulate material 45 from each respective leg support 13A–F. Drainage of particulate material 45 from at least one of the conduits 55 of each receptacle 41 may be done by actuation of the appropriate valve 48 and measurement of the amount of particulate material 45 removed from each conduit 55 in order to evenly settle each leg 40 within each receptacle 41.

The leveling and/or lowering process may be continued until the platform structure legs 40 are settled to a desired position adjacent the substructure leg supports 13A–F. At this time the legs 40 may be connected to the leg supports 13A–F by means such as welding. The final makeup dimension required for the welding of the leg supports 13A–F to the platform structure legs 40 may be precisely controlled by the continued draining of particulate material 45 from each respective leg support 13A–F.

At this point in time, the platform structure 10 has been precisely positioned, lowered, and connected to the substructure 12 without the use of a derrick barge. Damage normally encountered in connection operations of this nature has been minimized by use of cables 16A–H which initially position the vessel 11, cables 23, 23A–C which secure the vessel 11 to the leg supports 13A–F, vessel side extensions 21, 21A, 22, 22A, resilient material means 43 which soften the initial impacts of legs 40 to leg supports 13A–F, and particulate material 45 which may be removed to lower the structure 10 in a controlled manner to the final welding position, preferably after the vessel has been removed from beneath the platform structure 10.

Many other variations and modifications may be made in the apparatus and techniques hereinbefore described, both by those having experience in this technology, without departing from the concept of the present invention. Accordingly, it should be clearly understood that the apparatus and methods depicted in the accompanying drawings and referred to in the foregoing description are illustrative only and are not intended as limitations on the scope of the invention.

We claim as our invention:

1. Apparatus for use in lowering and connecting the lower end of downwardly-depending legs of an offshore platform structure to the upper end of upwardly-directed leg supports of a substructure, said connection means apparatus comprising;

a leg-receiving receptacle having an open top and a chamber defined downwardly therein formed at the upper end of a plurality of said substructure leg supports, closure means formed at the lower end of each of said receptacle chambers, a selected mass of a particulate material positioned in the lower portion of each receptacle chamber, drain means connected in fluid communication with the lower portion of said receptacle chamber of a size and location to allow a selective amount of said particulate material to be drained evenly from said receptacle chamber, valve means in said drain means to control the draining of said particulate material from said receptacle chamber, and a selected mass of resilient material means positioned in the upper portion of each receptacle chamber and carried by said particulate material.

2. Method of lowering and connecting the lower end of downwardly depending legs of an offshore platform structure to the upper end of upwardly-directed leg supports of a substructure located in a body of water, said method comprising:

positioning said downwardly-depending platform structure legs substantially centrally above said substructure leg supports, providing a select volume of particulate material on an upper portion of a plurality of said substructure leg supports, lowering said platform structure legs downwardly, operatively contacting at least one of said platform structure legs with said particulate material in a resilient manner by positioning resilient material means between the lower end of said platform structure leg and said particulate material, leveling the offshore platform structure legs on the substructure leg supports by removing particulate material from the upper portion of said leg supports, and lowering said platform structure legs to a selected position within said substructure leg supports by removing particulate material from said upper portion of said substructure leg supports.

3. Method of lowering and connecting the lower end of downwardly depending legs of an offshore platform structure to the upper end of upwardly-directed leg supports of a substructure located in a body of water, said method comprising;

forming in a plurality of said substructure leg supports a leg-receiving receptacle having an open top and a chamber defined downwardly therein, forming in each receptacle chamber closure means at the lower end of said chamber, drain means connected in fluid communication with the lower portion of said receptacle chamber of a size and location to allow a portion of a selected mass of particulate material positioned in the lower portion of each receptacle chamber to be drained from said receptacle chamber, and valve means in said drain means to control the draining of said particulate material from said receptacle chamber, positioning said downwardly-depending legs of said platform structure substantially centrally above said upwardly-directed substructure leg supports, lowering said platform structure legs towards said substructure leg supports, operatively contacting the lower ends of at least one of said platform structure legs with said particulate material positioned in the lower portion of each receptacle chamber in a resilient manner by positioning resilient material means between the lower end of said platform structure leg and said particulate material, draining particulate material from at least one of said receptacle chambers by actuation of said valve means, thereby lowering said platform structure legs to a position adjacent said substructure leg supports, and connecting said platform structure legs to said substructure leg supports.

* * * * *